United States Patent [19]

Kurita

[11] 4,231,182

[45] Nov. 4, 1980

[54] TOY VEHICLE HAVING REVERSING MECHANISM

[75] Inventor: Toshiaki Kurita, Tokyo, Japan

[73] Assignee: Tomy Kogyo Co., Inc., Tokyo, Japan

[21] Appl. No.: 972,018

[22] Filed: Dec. 21, 1978

[30] Foreign Application Priority Data

Jun. 13, 1978 [JP] Japan ..... 53-71636

[51] Int. Cl.[3] ..... A63H 17/40

[52] U.S. Cl. ..... 46/212; 46/39; 46/219; 46/262

[58] Field of Search ..... 46/211, 212, 213, 262, 46/263

[56] References Cited

U.S. PATENT DOCUMENTS

| | | | |
|---|---|---|---|
| 2,117,597 | 5/1938 | Berger | 46/213 X |
| 2,124,302 | 7/1938 | Lohr et al. | 46/211 |
| 2,587,052 | 2/1952 | Lohr | 46/213 |
| 3,065,569 | 11/1962 | Nielsen et al. | 46/262 |

FOREIGN PATENT DOCUMENTS 337714 6/1921 Fed. Rep. of Germany .

*Primary Examiner*—F. Barry Shay

*Attorney, Agent, or Firm*—K. H. Boswell; Edward D. O'Brian

[57] ABSTRACT

A toy vehicle having a base section and a turret section is movably supported on a plurality of wheels. Located in the interior of the vehicle is a motor which is suitably connected to at least one of the wheels of the vehicle. Included in the connecting mechanism between the motor and the wheels is a reversing mechanism for reversing the direction of rotation of the driving of the wheels and thus the direction of the travel of the vehicle. The reversing mechanism also incorporates a trip switch having a position corresponding to movement of the vehicle in one direction and a second position corresponding to movement of the vehicle in the other direction. The trip mechanism is tripped by an outside stimulus, e.g. a metal ball. Operatively connected to the trip mechanism is an exposure mechanism which alternately extends and then retracts a portion of the trip mechanism in and out of the body of the vehicle. This results in the trip mechanism only being exposed to the outside stimulus when the trip mechanism is extended outside of the body of the vehicle. The vehicle can also include an indicating mechanism which indicates the status of the trip mechanism, that is it would tell an observer whether or not the trip mechanism is exposed from the vehicle body and thus whether or not the direction of the vehicle can be reversed. A rotatable turret may be provided, with means causing it to change its direction when the vehicle reverses. The turret may have a horizontal projecting member which is rotatable about its own axis.

14 Claims, 5 Drawing Figures

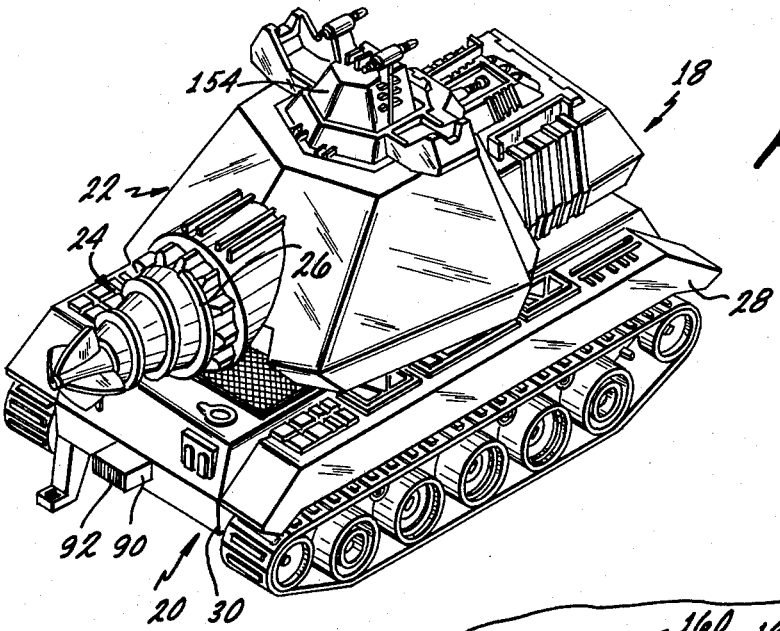
FIG. 1
FIG. 4
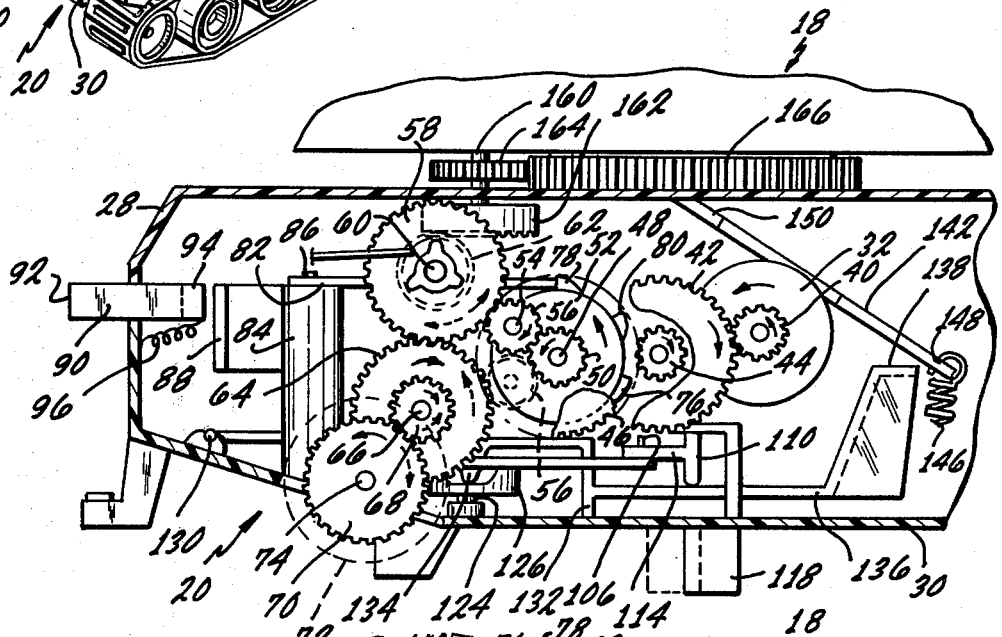
FIG. 5
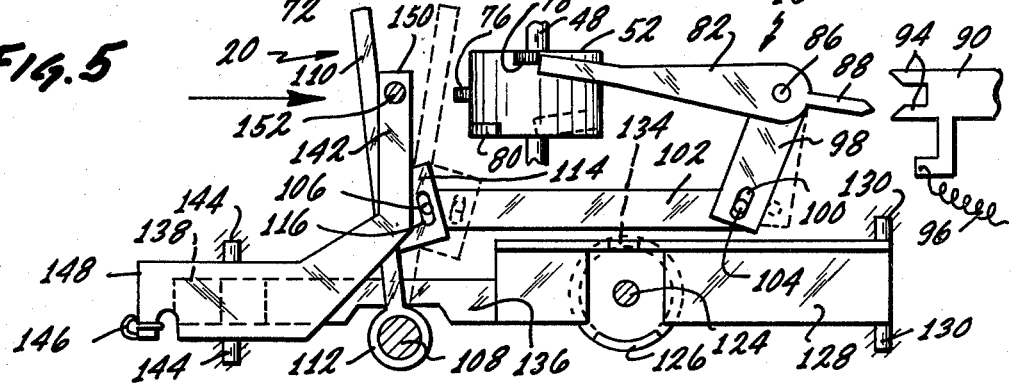

TOY VEHICLE HAVING REVERSING MECHANISM

CROSS REFERENCE TO RELATED APPLICATIONS

This application Ser. No. 971,939 is related to my application concurrently filed with this application and entitled TOY HAVING REVERSIBLE MOVABLE OBJECT, the disclosure of which is herein incorporated by reference.

BACKGROUND OF THE INVENTION

This invention is directed to a toy vehicle which has a switch mechanism for changing the direction of the vehicle. Further this switch mechanism includes an exposure mechanism which only allows the switch mechanism to be operated upon by an external stimulus during alternate intervals.

There are at present many toy vehicles on the market for purchase by the consuming public. The largest majority of these vehicles are simply supported on free wheeling wheels and rely upon the child using them for both propulsion power and direction of propulsion. Other toy vehicles such as trains or cars riding on tracks or simple wind up toys have internal mechanisms which provide the propulsion power of the toy.

In a further class of toys, such as one currently on the market under the trademark of BIG LOADER (registered trademark), the vehicles have their own internal propulsion means and additionally propulsion direction switches which change the direction of travel of the vehicles.

While these vehicles are interesting to play with and are appealing to different age levels depending upon the sophistication of the vehicle these vehicles are not known to be useful for the use in games wherein the skill of one player is pitted against the skill of another player.

BRIEF SUMMARY OF THE INVENTION

In view of the above it is an object of this invention to provide a vehicle which is useful in games pitting the skill of one player against the skill of another player such as the game described in my application entitled TOY HAVING REVERSABLE MOVING OBJECT filed concurrently with this application. It is a further object of this invention to provide a vehicle which is not only capable of propelling itself and reversing direction of movement but is also capable of changing its direction of movement in response to an outside stimulus and further being able to alternate between an operational mode wherein it is capable of changing direction of movement upon application of an outside stimulus and a second mode of operation wherein it is not capable of changing direction upon the application of an outside stimulus.

In view of the above object and other objects which will become evident upon the remainder of this specification, there is provided a toy vehicle having a vehicle body and movable support means movably supporting said vehicle body on a support surface; within the interior of the body of the vehicle is a locomotion means for moving said vehicle along said support surface; integrally formed with the vehicle is a direction changing means for changing the direction of movement of the vehicle and further the direction changing means includes a switch means for controlling the direction of the movement; associated with the switch means is an exposure means which alternately exposes the switch means between an exposed position wherein the switch means can be acted upon by an external stimulus and a protected position wherein the switch means cannot be acted upon by the external stimulus.

The vehicle body can include several sections including a base section mounted on wheels and a turret section rotatably mounted on the base section. The turret section is operatively connected to the direction changing means so as to rotate the turret when the vehicle changes direction. If the turret is asymmetrical having a differently appearing forward end and rear end this allows for the turret's forward end always to be projecting toward the direction of travel of the vehicle while allowing the base section to simply go backward and forward because of reversal of direction of its driving wheels.

As a guide to those operating the vehicle, a switch position indicating means can be included which is coordinated with the switch means and indicates to the operator of the toy when the switch is in a position such that it can be operated on by an external stimulus. While for the purpose of the embodiment illustrated the switch means is shown as a mechanical trip member. Other embodiments could utilize electrical or other similarly activated switching means.

BRIEF DESCRIPTION OF THE DRAWINGS

This invention will be better understood when taken in conjunction with the drawings wherein:

FIG. 1 is an isometric view of the toy vehicle of the invention;

FIG. 4 is a partial side elevational view in section of certain mechanical components of the toy as viewed from the right side of FIG. 1; and FIG. 5 is a top plan view of certain of the interior mechanisms of the toy including a first orientation of these mechanisms in solid line and a second orientation of these mechanisms in phantom line.

Figure 2:
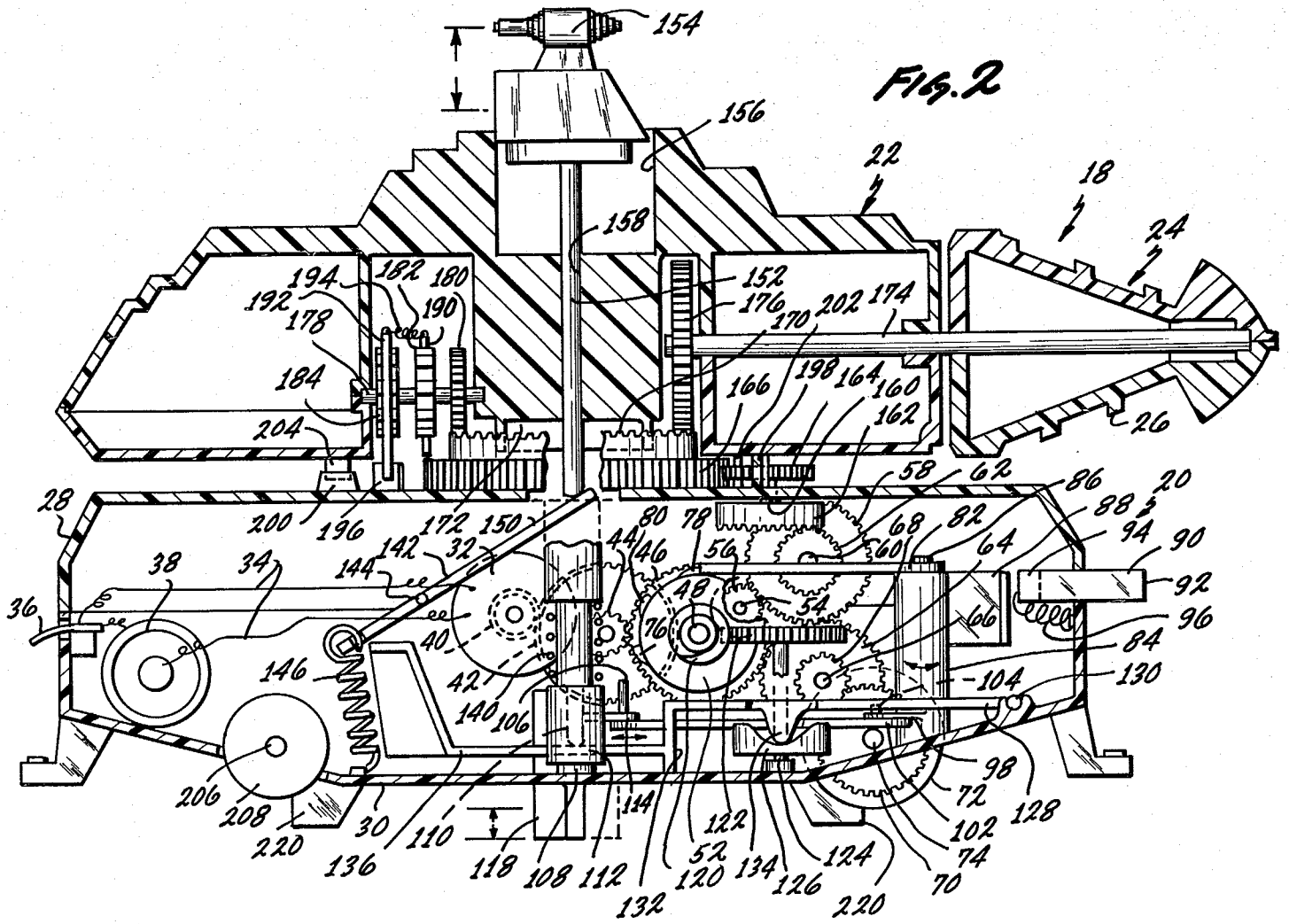
FIG. 2 is a side elevational view in section of the vehicle shown in FIG. 1 as viewed from the left side of FIG. 1.

The toy of this invention described in the specification and illustrated in the drawings uses certain operative concepts and principles which are set forth in the appended claims forming a part of this specification. Those skilled in the toy arts will recognize that these principles and concepts could be utilized in a variety of differently appearing or differently describable embodiments. For this reason this invention is not to be construed as to be limited to the exact embodiment described in this specification and shown in the drawings but is to be construed in light of the appended claims.

DETAILED DESCRIPTION

The vehicle 18 has two main sections. A base section 20 and a turret section 22 which is rotatably mounted as hereinafter described on top of the base section 20. Projecting out of the front of the turret 22 is a conical member 24 having a helical screw 26 on the surface thereof which turns when the vehicle is moving as hereinafter described.

The base 20 is composed of a top section 28 and a bottom section 30 and together they form a housing for numerous gears and other parts. For the sake of simplicity in this specification generally most of the gears and axles found in the interior of the base 20 will only be described as to their operation. The top and bottom sections 28 and 30 of base 20 contain numerous drillings and cutouts which serve as mountings or bearing surfaces for these components. It will be understood that all of the gears, axles, etc. are appropriately conventionally mounted within the base 20.

A motor 32 is connected by suitable wiring 34 to an off/on switch 36 and a battery pack 38. When in the on position the motor 32 drives pinion 40 which is engaged with a spur gear 42. Integrally formed with spur gear 42 is pinion 44. Pinion 44 mates with and drives spur gear 46. Spur gear 46 is fixedly attached to axle 48 and also mounted to axle 48 and integrally formed with spur gear 46 is pinion 50. A drum 52 is mounted adjacent to pinion 50 on axle 48; however, drum 52 is freewheeling about axle 48 and its rotation on the axle 48 is theoretically independent of both pinion 50 and spur gear 46. A small axle 54 projects from one side of drum 52 toward pinion 50. A pinion 56 is mounted on axle 54 and engages with pinion 50. Thus, as pinion 50 spins about axle 48 pinion 56 is caused to rotate about axle 54.

A spur gear 58 is mounted to an axle 60. A large pinion 62 is also attached to the axle 60 and is rotated by axle 60 in response to rotation of spur gear 58. A spur gear 64 identical in size and teeth number with spur gear 58 is mounted below spur gear 58 about an axle 66 and axle 66 is so placed within bottom section 20 that the teeth of spur gear 64 mesh with the teeth of spur gear 58. Integrally formed with and coaxial with spur gear 64 on axle 66 is a pinion 68. Pinion 68 engages with a spur gear 70 which is integrally formed with a driving wheel 72 mounted on an axle 74. On the opposite side of axle 74 is a second driving wheel 75.

Spur gears 58 snd 64 are spatially placed in relationship to drum 52 such that pinion 56 is capable of meshing with and driving both spur gear 58 and 64. This is best seen in FIG. 4. If drum 52 is fixedly held in the position shown in solid line in FIG. 4 pinion 56 meshes with spur gear 58. If pinion 56 is fixedly held in the position shown in phantom in FIG. 4 pinion 56 meshes with and drives spur gear 64. Motor 42 rotates as shown by the solid arrow. This rotation is transferred via pinion 40, spur gear 42, pinion 44, spur gear 46 and pinion 50 to pinion 56. When pinion 56 is engaged with spur gear 58 spur gear 58 is caused to rotate in the direction shown by the solid line. This in turn causes spur gear 64 to rotate in the direction shown by solid lines and this motion in turn is transferred to pinion 68, spur gear 70 and ultimately to driving wheel 72 turning driving wheel 72 in the direction shown by the solid arrow. If instead of engagement with the spur gear 58, pinion 56 is engaged directly with spur gear 64, spur gear 64 is driven in the direction shown by the broken arrow. This also causes spur gear 58 and large pinion 62 to rotate in the direction shown by the broken arrow, the significance which will be described hereinafter, and additionally causes driving wheel to rotate in the direction shown by the broken arrow. This allows for reversal of the direction of the driving wheel 72 depending upon whether pinion 56 is engaged with either spur gear 58 or spur gear 64 and consequently reversal of the direction of travel of vehicle 18.

The placement of pinion 56 is governed by the rotary displacement of drum 52 about axle 48. Drum 52 has three small lugs or teeth 76, 78 and 80 on its surface. A lug retention member 82 fits against lugs 76, 78 and 80 respectively. The lugs 76, 78 and 80 are so placed on the surface of drum 52 that when lug 78 is engaged with lug retention member 82 pinion 56 is engaged with spur gear 58. When lug 80 is engaged with lug retention member 82 pinion 56 is engaged with spur wheel 64. When lug 76 is engaged with lug retention member 82 pinion 56 is not engaged with either of spur gears 58 and 64 and as a consequence the motion of motor is not transferred to driving wheel 72 and the vehicle 18 does not move.

When the vehicle 18 is viewed from the direction shown in FIG. 4, the direction of rotation of motor 32 is counterclockwise. By the gearing hereintofore described this results in the direction of drum 52 to also be counterclockwise. Because pinion 56 is mounted on axle 54 a counterclockwise momentum is imparted to drum 52 by rotation of pinion 50. This momentum holds the lugs 76, 78 and 80 against the surface of lug retention member 82 whenever lug retention member 82 is directly in line with any of these lugs.

Lug retention member 82 is fixedly attached to the top of a sleeve 84. Sleeve 84 contains a central hole (not separately numbered) allowing sleeve 84 to be slipped over an upright shaft 86 which in turn is attached to bottom section 30. As such sleeve 84 is free to pivot about upright shaft 86 allowing the lug retention member 82 to swing transversely across the surface of drum 52. A centering member 88 is also attached to sleeve 84. Slidably mounted in bottom section 30 is a slidable locking member 90 having a lobe 92 on one end which projects out of the bottom section 30 and is accessible to the operator of the toy and a pair of tines collectively identified by the numeral 94 which project in the opposite direction toward centering member 88. Locking member 90 is biased away from sleeve 84 by a spring 96. When lobe 92 is depressed the tines 94 of locking member 90 slip over centering member 88 and fixedly hold lug retention member 82 in the path of lug 76 and as a consequence of this the vehicle 18 is not driven in either direction but remains stationary even though motor 32 is running.

Figure 3:
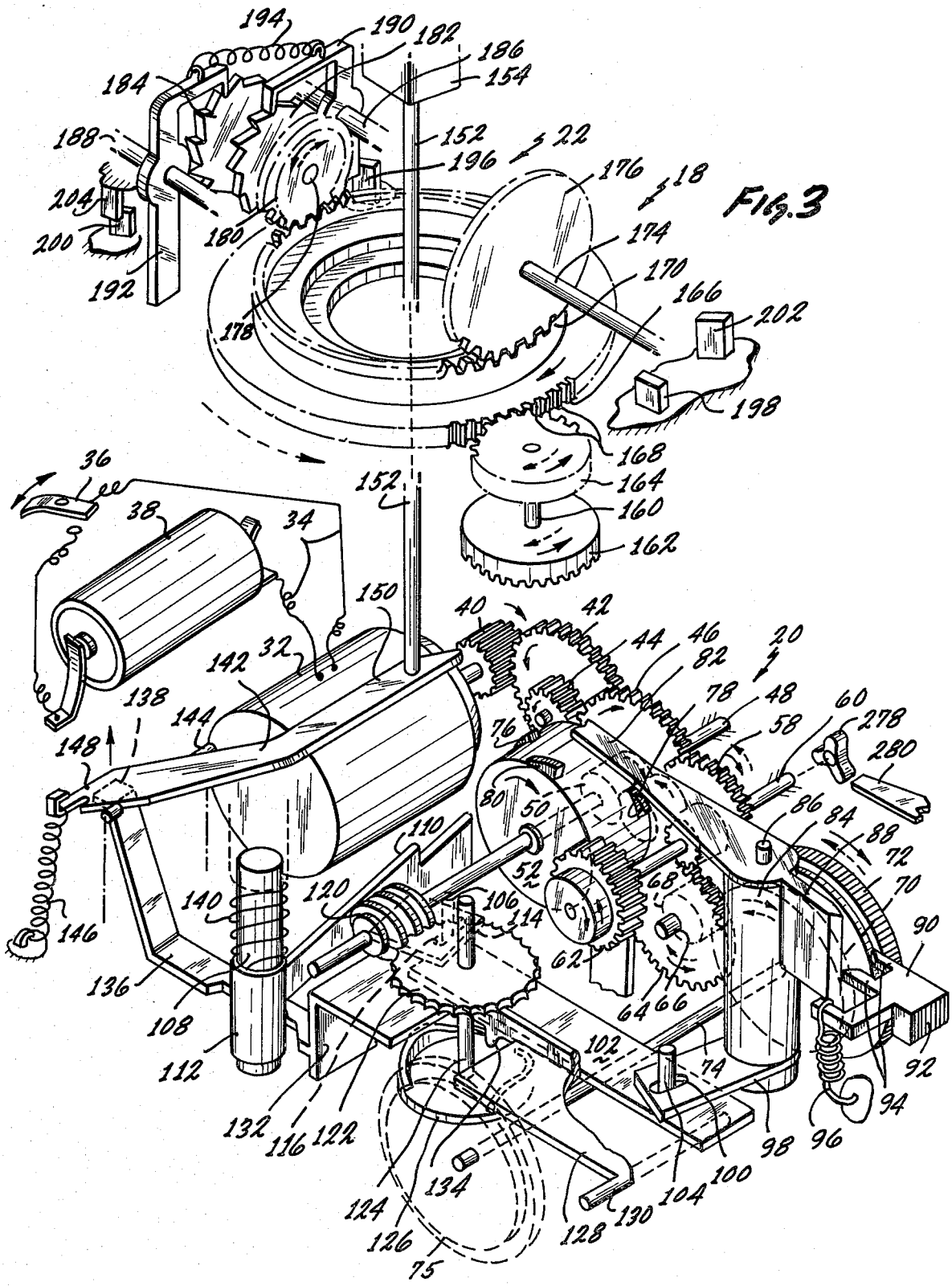
FIG. 3 is an exploded isometric view of the mechanical components inside of the toy.

Extending laterally from sleeve 84 near its bottom end is an arm 98. As can be seen in FIGS. 3 and 5, arm 98 projects almost (approximately 70 to 80 degrees) perpendicular to lug retention member 82. Motion of arm 98 arcuately about sleeve 84, as illustrated by the solid and phantom positions shown in FIG. 5, produces essentially transverse movement of the end of lug retention member 82 across the surface of drum 52 in between the path of lugs 78 and 80 and including an interference position with lug 76. Arm 98 includes an elongated channel 100 nearest the end which is not attached to sleeve 84. A second arm 102 is slidably mounted in a longitudinal position with respect to vehicle 18. Arm 102 has two upstanding pegs 104 and 106 near the end thereof. Peg 104 fits into channel 100 of arm 98.

An upstanding shaft 108 is fixed to bottom section 30 in a position as shown in FIGS. 3 and 5. A transverse member 110 has a bearing section 112 on one end thereof and bearing section 112 fits over shaft 108 allowing transverse member 110 to pivot about shaft 108. Projecting out of the side of transverse member 110 toward arm 102 is a short arm 114. Arm 114 contains a channel 116. Channel 116 fits over upstanding peg 106. A switch member or tilt member 118 is integrally formed on the bottom of transverse member 110 and is capable of projecting through a hole (not shown) in the bottom of bottom section 30.

Tilt member 118, as hereinafter described, can be exposed below the bottom surface of bottom section 30. When it is exposed, this allows tilt member 118 to by physically moved by a force on the outside of vehicle 18. Any back and forth movement of tilt member 118 along the longitudinal axis of vehicle 18 is transferred to transverse member 110. Transverse member 110 in turn rotates about shaft 108 causing arm 102 to slide longitudinally back and forth within the interior of bottom section 30. This movement is in turn communicated to arm 98, sleeve 84, and ultimately to lug retention member 82. The position of lug retention member 82 is therefore in a direct response to the longitudinal position of tilt member 118. However, if centering member 88 is fixed by locking member 90 both lug retention member 82 and tilt member 118 are held in a locked position.

On the end of axle 48 distal from pinion 50 is a worm gear 120. A worm wheel 122 is fixedly attached to an upright axle 124 which is free to spin in a bearing surface (not shown) in bottom section 30. Near the lower end of axle 124 is a two-lobed cam wheel 126. Cam wheel 126 is fixedly attached to axle 124 and therefore rotates in respect to rotation of axle 124. As hereinafore described axle 48 turns in respect to motion of motor 32. This rotary motion of axle 48 is transferred to cam wheel 126 by the interaction of worm wheel 122 with worm gear 120 causing cam wheel 126 to rotate.

A lifting member 128 is journaled at one end about two pins collectively identified by the numeral 130 integrally attached to one end of lifting member 128. Pins 130 fit into appropriate bearings in bottom section 30. Lifting member 128 projects from pins 130 across the top surface of cam wheel 126 and then makes a 90° bend and becomes vertical section 132. Vertical section 132 extends down toward the bottom of base section 30. Integrally formed on the undersurface of lifting member 128 is a cam follower 134 which mates with the cam surfaces of cam wheel 126. As cam 126 rotates lifting member 128 is caused to pivot about pins 130. Extending from vertical section 132 of lifting member 128 is lifting extension 136. Lifting extension 136 passes underneath transverse member 110 and then projects upwardly until it culminates at end 138.

An upward and downward motion of lifting member 128 is caused by the interaction of cam follower 134 on the cam surfaces of cam wheel 126 as cam 126 rotates. This upward and downward motion is transmitted to transverse member 110 by lifting extension 136. Transverse member 110 slides up and down about bearing 112 vertically on shaft 108 causing tilt member 118 to alternately project through the bottom of bottom section 30 and then be retracted into the interior of bottom section 30. As this happens arm 114 rides up and down on upstanding peg 106. However, peg 106 is of sufficient length that arm 114 never is completely free of peg 106. A spring 140 fits on shaft 108 and when top section 28 is fitted to bottom section 30 spring 140 abuts against top section 28 and biases transverse member 110 toward the bottom of bottom section 30. This in turn, because transverse member 110 lies across lifting extension 136, holds cam follower 134 against the cam surfaces of cam wheel 126.

A turret lifting member 142 having two pins collectively identified by the numeral 144 is mounted to bottom section 30 about pins 144. A spring 146 biases end 148 of turret lifting member 142 in a downward direction. End 138 of lifting extension 136 fits underneath turret lifting member 142 near end 148. As lifting extension 136 rises and falls with respect to motion of cam wheel 126 this motion is communicated to turret lifting member 142. As end 138 of lifting extension 136 is raised it pushes up on end 148 of turret lifting member 142. Turret lifting member 142 spins about pins 144 and the opposite end 150 of turret lifting member 142 drops. As lifting extension 136 descends in response to the position of cam follower 134 on cam wheel 126 spring 146 biases end 150 of turret lifting member 142 in an upward direction. The upward and downward motion of end 150 of turret lifting member 142 is transferred to a shaft 152 extending from the bottom of a turret signaling device 154. Under the influence of gravity, shaft 152 rests against turret lifting member 142.

Extending down through the center of turret 22 is a large drilling 156. In the center of drilling 156 is a second drilling 158. Turret signaling device 154 is of a smaller dimension than drilling 156 allowing turret signaling device 154 to fit within the interior of drilling 156. Shaft 152 extends from the bottom of turret signaling device 154 though drilling 158 and abuts against turret lifting member 152.

Both the turret signaling device 154 and its attached shaft 152 are free to move within their respective drillings 156 and 158. Since shaft 152 rests on turret lifting member 142 the movement of turret lifting member 142 is transferred to turret signaling device 154. Because of the attachment of lifting member 128 about pins 130 and turret lifting member 142 about pins 144, as tilt member 118 is lifted up into the body of bottom section 30 turret signaling device 154 is allowed to descend under the influence of gravity into drilling 156 and as tilt member 118 descends downwards out of the body of bottom section 30 turret signaling device 154 is raised out of the drilling 156. Thus by visually perceiving the position of turret signaling device 154 one knows the position of tilt member 118, i.e. the turret signaling device 154 is up when the tilt member 118 is down and vice versa.

A shaft 160 extends through a hole (not shown) in top section 28. Mounted on the bottom of shaft 160 is a crown wheel 162 and mounted on the top of shaft 160 is a spur wheel 164. As such crown wheel 162 is located within the body of base 20 and spur wheel 164 is held slightly above the top surface of top section 28. Crown wheel 162 mates with large pinion 62 and thus the rotation of large pinion 62 is transferred to spur wheel 164. As hereinafore described spur gear 58 is capable of being rotated in both a clockwise and a counterclockwise direction. This movement of spur gear 58 is transferred by axle 60 to large pinion 62 which in turn transfers this motion to spur wheel 164 causing spur wheel to move both clockwise and counterclockwise. A large gear 166 rests on the top surface of top section 28 about an upstanding boss (not shown) which extends upward from top section 28. The boss fits into the centralized hole in the center of large gear 166 maintaining large gear 166 centered on base 20. Extending around the perimeter of large gear 166 are spur teeth 168. Extending around the top surface of large gear 166 are crown teeth 170. Spur teeth 168 mesh with crown wheel 162 and as such the rotation of pinion 62 is transferred to large gear 166. A skirt 172 extends down from the bottom of turret 22 and fits inside of crown teeth 170 of large gear 166. This centers turret 22 on large gear 166 and base 20 and allows turret 22 to pivot about large gear 166 and base 20.

A shaft 174 extends horizontally through turret 22 into conical member 24. Conical member 24 is fixedly attached to shaft 174 on one end thereof and a spur gear 176 is fixedly attached to the other end of shaft 174. Spur gear 176 mates with crown teeth 170 and transmits motion of large gear 166 to conical member 24. Since large gear 166 spins in either direction depending upon the direction of pinion 62, conical member 24 also is capable of spinning in both direction.

Within the interior of turret 22 on the side opposite conical member 24 is a shaft 178. Fixedly attached to shaft 178 is spur gear 180 which mates with crown teeth 170 and rotates shaft 178 in respect to its rotation on large gear 166. Two ratchet wheels 182 and 184 are also attached to shaft 178. Ratchet wheel 172 is oriented on shaft 178 so that its teeth project opposite to the direction of the teeth on ratchet wheel 184. Two shafts 186 and 188 extend parallel within turret member 22 to shaft 178. Two escape mechanisms 190 and 192 are mounted about shafts 186 and 188 respectively. Escape mechanism 190 interacts with ratchet wheel 182 and escape mechanism 192 interacts with ratchet wheel 184. A spring 194 connects to both of the tops of escape mechanism 190 and 192 as shown in FIG. 3 and biases the escape mechanism into holding positions with their respective ratchet wheels.

As previously noted large gear 166 is free to spin about a boss extending from the top of top section 28. Referring now specifically to FIG. 3 if spur gear 162 is rotated in the direction shown in solid lines this rotation is transferred to large gear 166 and causes large gear 166 to rotate on the top surface of top section 28 in the direction shown in solid lines. If the escape mechanism 190 was not interacting with ratchet wheel 182 spur gear 180 also would be free to rotate in the direction shown in the solid line. However, as shown in FIG. 3 spur gear 180 cannot turn in the direction shown in the solid line because escape mechanism 190 is locked against ratchet wheel 182. As a consequence of this the turret 22 and the components attached to it, i.e. escape mechanisms 190 and 192, the ratchet wheels 182 and 184 and spur gear 180, are fixedly held in respect to large gear 166. Thus, the turret 22 is locked to large gear 166 and is forced to move in the same direction as large gear 166.

Fixedly attached on the top surface of top section 28 are two ratchet trip pegs 196 and 198 and two stop pegs 200 and 202. As the turret 22 turns in the direction shown in the solid arrow escape mechanism 190 abuts against ratchet trip peg 196 causing the escape mechanism 190 to pivot about axle 186 and free ratchet wheel 182. This allows spur gear 180 to rotate in the direction shown by solid arrow. Just after escape mechanism 190 contacts ratchet trip peg 196 a turret stop peg 204 which extends from the turret toward the top section 28, contacts stop peg 200. This prevents the turret 22 from any further movement in the direction shown by the solid arrow.

When spur wheel 162 is caused to rotate in the direction shown by the broken arrow large gear 166 reverses direction and also turns in the direction shown in the broken arrow. Since spur gear 180 is prevented from traveling in the direction shown in the broken arrow because of interaction of escape mechanism 192 with ratchet wheel 184, turret 22 is caused to spin in the direction shown by the broken arrow. As a consequence of the turret 22 turning in this direction turret stop peg 204 starts to rotate away from stop peg 200 and escape mechanism 190 starts to rotate away from ratchet trip peg 196. The turret 22 then turns 180 degrees with respect to the base 20 until escape mechanism 192 abuts against ratchet trip peg 198. This lifts escape mechanism 192 from the surface of ratchet wheel 184 and allows spur gear 180 to turn in the direction shown by the broken arrow. Shortly thereafter turret stop peg 204 abuts against stop peg 202 holding turret 22 in this new position. The turret 22 will remain in this position until the direction of rotation of spur gear 58 once again is reversed. At this time large gear 166 and turret 22 will again turn in the direction shown by the solid arrow as previously described. Ratchet trip pegs 196 and 198 are so placed in respect to one another on the surface of body 20 that they do not interfer with the interaction of each with its respective escape mechanism.

As a consequence of the reversal of direction of large gear 166 spur gear 176 also turns in both directions. The stop pegs 200 and 202 and the turret stop peg 204 are positioned such that the limits of travel of the turret 22 about large gear 166 result in conical member 24 being pointed either toward one end or the other of the vehicle 18. Further, the stop pegs 200 and 202 are so positioned that conical member 24 points in the direction of travel of the vehicle 18. Because spur gear 176 reverses direction, consequently the conical member 24 will spin one way when pointed toward one end of the vehicle 18 and spin the opposite way when pointed toward the other end. As the result of this opposite spin of conical member 24 the helical screw 26 on the conical member 24 will first turn in toward the body of the vehicle 18 when the vehicle 18 is going in one direction and will turn out away from the body of the vehicle 18 when the vehicle 18 is going in the opposite direction. Along with the reversal of direction of the vehicle 18 this spin of the helical screw 26 makes for an interesting visual effect.

At the opposite end of the vehicle 18 is a second axle 206 having two wheels collectively identified by the numerals 208 on the ends thereof. The wheels 208 are free to spin about axle 206 allowing the vehicle 18 to ride over a surface in response to propulsion by driving wheels 72 and 75.

For a more realistic effect during the operation of the vehicle 18 shaft 60 contains a three lobed cam 278 on the end opposite of spur gear 62. A flexible member 280 integrally formed with top body section 28 extends toward and slightly touches cam 278. Rotation of axle 60 causes cam 278 to flip against flexible member 280 emitting a sound imitating a motor-like noise.

I claim:

1. A toy vehicle which comprises:

a vehicle body;

movable support means movably supporting said vehicle body on a support surface;

locomotion means including portions having relative movement with respect to each other for moving said vehicle along said support surface;

direction changing means operatively connected to said locomotion means for changing the direction of movement along said support surface by reversing the direction of said relative movement of at least a portion of said locomotion means;

said direction changing means including a switch means for controlling the direction of said movement, said switch means having at least two positions, a first of said positions corresponding to the movement of said vehicle in one direction and a second of said positions corresponding to movement of the vehicle in another direction, said switch means moving between said positions in response to stimulation of said switch means by a stimulus external to said vehicle body;

exposure means for exposing said switch means alternately between an exposed position, wherein said switch means can be acted upon by said stimulus external to said vehicle body changing the direction of movement of said vehicle body in response to movement of said switch means between said first of said positions corresponding to the movement of the vehicle in one direction and said second of said positions corresponding to movement of the vehicle in another direction, and a protected position wherein said switch means cannot be acted on by said stimulus to change the direction of movement of said vehicle.

2. The toy of claim 1 wherein:

said exposure means includes a position change means for changing said switch means between said exposed position wherein said switch means is capable of being acted upon by said external stimulus and said protected position wherein said switch means is not capable of being acted upon by said stimulus.

3. The toy of claim 2 wherein:

said position change means is operatively connected to said switch means shifting the position of said switch means between a first position wherein said switch means is capable of being acted upon by said external stimulus and a second position wherein said switch means is not capable of being acted upon by said stimulus.

4. The toy of claim 3 wherein:

said switch means comprises a trip member;

said trip member having a first position corresponding to movement of said vehicle in one direction, said trip member having a second position corresponding to movement of said vehicle in said other direction.

5. The toy of claim 4 wherein:

said position change means comprises extension-retraction means for extending at least a portion of said trip member outside of said vehicle body exposing said portion of said trip member to said stimulus and for at least partially retracting said trip member within said vehicle body preventing exposure of said portion of said trip member to said stimulus.

6. The toy of claim 5 wherein:

said movable support means comprises said vehicle body including rolling means mounted to said vehicle body and rollably supporting said vehicle body on said surface;

said locomotion means comprises a motor means located in said vehicle and operatively connected to said rolling means.

7. The toy of claim 1 wherein:

said vehicle body comprises at least two sections, a base section and a turret section;

said turret section rotatably mounted on said base section;

turret rotation means for rotating said turret on said base section;

said turret rotation means operatively connected to said direction changing means such that said turret rotation means is activated by said direction changing means.

8. The toy of claim 7 wherein:

said turret section has a front end and a rear end, said turret rotation means rotates said turret section such that said front end of said turret section is always directed to the direction of movement of said vehicle body.

9. A toy vehicle which comprises:

a vehicle body;

movable support means movably supporting said vehicle body on a support surface;

locomotion means for moving said vehicle along said support surface;

direction changing means operatively connected to said locomotion means for changing the direction of movement along said support surface by reversing the direction of at least a portion of said locomotion means;

said direction changing means including a switch means for controlling the direction of said movement, said switch means having at least two positions, a first of said positions corresponding to the movement of said vehicle in one direction and a second of said positions corresponding to movement of the vehicle in another direction, said switch means moving between said positions in response to stimulation of said switch means by a stimulus external to said vehicle body;

exposure means for exposing said switch means alternately between an exposed position, wherein said switch means can be acted upon by said stimulus external to said vehicle body changing the direction of movement of said vehicle body in response to movement of said switch means between said first of said positions corresponding to the movement of the vehicle in one direction and said second of said positions corresponding to movement of the vehicle in another direction, and a protected position wherein said switch means cannot be acted on by said stimulus to change the direction of movement of said vehicle;

said exposure means including a position change means for changing said switch means between said exposed position wherein said switch means is capable of being acted upon by said stimulus and said protected position wherein said switch means is not capable of being acted upon by said stimulus;

said position change means being operatively connected to said switch means for shifting the position of said switch means between a first position wherein said switch means is capable of being acted upon by said stimulus and a second position wherein said switch means is not capable of being acted upon by said stimulus;

said switch means comprising a trip member;

said trip member having a first position corresponding to movement of said vehicle in one direction, said trip member having a second position corresponding to movement of said vehicle in said other direction;

said position change means comprising extension-retraction means for extending at least a portion of said trip member outside of said vehicle body exposing said portion of said trip member to said stimulus and for at least partially retracting said trip member within said vehicle body preventing exposure of said portion of said trip member to said stimulus;

said movable support means comprising said vehicle body including rolling means mounted to said vehicle body and rollably supporting said vehicle body on said surface;

said locomotion means comprising a motor means located in said vehicle and operatively connected to said rolling means;

said direction changing means including at least four gears, a first gear, a second gear, a third gear and a fourth gear;

said first gear operatively connected to said motor means;

said third gear and said fourth gear operatively connected to each other, said fourth gear operatively connected to said rolling means;

said second gear operatively connected to said first gear and alternately capable of operatively connecting to either of said third gear or said fourth gear such that said motor means is operatively connected to said rolling means through either a first gear train including said first gear operatively connected to said second gear said second gear operatively connected to said third gear and said third gear operatively connected to said fourth gear, or a second gear train including said first gear operatively connected to said second gear and said second gear operatively connected to said fourth gear, said second gear train excluding said third gear.

10. The toy of claim 9 including:

said vehicle body comprising at least two sections, a base section and a turret section;

said turret section rotatably mounted on said base section;

turret rotation means for rotating said turret on said base section;

said turret rotation means operatively connected to said direction changing means such that said turret rotation means is activated by said direction changing means;

said turret section having a front end and a rear end, said turret rotation means rotates said turret section such that said front end of said turret section is always directed to the direction of movement of said vehicle body;

said turret section having a rotating member mounted on said front end of said turret section, said rotating member rotating when said vehicle body moves along said support surface;

a switch position including means indicating which of said positions said switch is in;

said switch position indicating means operatively connected to said switch means;

said direction changing means including a cylindrical drum member rotatably mounted on an axle about the longitudinal axis of said cylindrical drum member;

at least two lug members attached to the curved surface of said cylindrical drum;

a rotatably mounted lug retention member positioned proximal to the cylindrical surface of the cylindrical drum member;

said lug retention member substantially capable of traveling transversly over the cylindrical surface of the cylindrical drum member and interacting with said lug member.

11. The toy of claim 10 wherein:

said rolling means includes a plurality of wheels.

12. A toy vehicle which comprises:

a vehicle body;

movable support means movably supporting said vehicle body on a support surface;

locomotion means for moving said vehicle along said support surface;

direction changing means operatively connected to said locomotion means for changing the direction of movement along said support surface by reversing the direction of at least a portion of said locomotion means;

said direction changing means including a switch means for controlling the direction of said movement, said switch means having at least two positions, a first of said positions corresponding to the movement of said vehicle in one direction and a second of said positions corresponding to movement of the vehicle in another direction, said switch means moving between said positions in response to stimulation of said switch means by a stimulus external to said vehicle body;

exposure means for exposing said switch means alternately between an exposed position, wherein said switch means can be acted upon by said stimulus external to said vehicle body changing the direction of movement of said vehicle body in response to movement of said switch means between said first of said positions corresponding to the movement of the vehicle in one direction and said second of said positions corresponding to movement of the vehicle in another direction, and a protected position wherein said switch means cannot be acted on by said stimulus to change the direction of movement of said vehicle;

said vehicle body comprising at least two sections, a base section and a turret section;

said turret section rotatably mounted on said base section;

turret rotation means for rotating said turret on said base section;

said turret rotation means operatively connected to said direction changing means such that said turret rotation means is activated by said direction changing means;

said turret section having a front end and a rear end, said turret rotation means rotating said turret section such that said front end of said turret section is always directed to the direction of movement of said vehicle body;

and including;

said turret section having a rotating member mounted on said front end of said turret section and rotatable about an axis at an angle to the axis of rotation of said turret, said rotating member rotating when said vehicle body moves along said support surface.

13. The toy of claim 12 including:

a switch position indicating means indicating which of said positions said switch is in;

said switch position indicating means operatively connected to said switch means.

14. The toy of claim 13 wherein:

said direction changing means includes a cylindrical drum member rotatably mounted on an axle about the longitudinal axis of said cylindrical drum member;

at least two lug members attached to the curved surface of said cylindrical drum;

a rotatably mounted lug retention member positioned proximal to the cylindrical surface of the cylindrical drum member;

said lug retention member substantially capable of traveling transversly over the cylindrical surface of the cylindrical drum member and interacting with said lug member.

* * * * *